United States Patent [19]

Sze et al.

[11] Patent Number: 5,034,182

[45] Date of Patent: Jul. 23, 1991

[54] MELT SPINNING PROCESS FOR POLYMERIC FILAMENTS

[75] Inventors: Benjamin C. Sze; George Vassilatos, both of Wilmington, Del.

[73] Assignee: E. I. Du Pont de Nemours and Company, Wilmington, Del.

[21] Appl. No.: 857,289

[22] Filed: Apr. 30, 1986

[51] Int. Cl.[5] ..... D01D 5/084; D01D 5/098

[52] U.S. Cl. ..... 264/555; 264/210.2; 264/210.8; 264/211.14; 425/72.2

[58] Field of Search ..... 425/725; 264/211.13, 264/555, 210.2, 210.8, 211.14

[56] References Cited

U.S. PATENT DOCUMENTS

| | | | |
|---|---|---|---|
| 2,604,667 | 7/1952 | Hebeler . | |
| 2,957,747 | 10/1960 | Bowling . | |
| 3,091,015 | 5/1963 | Zimmerman . | |
| 3,257,487 | 6/1966 | Dulin, Jr. | 426/72 S |
| 3,271,818 | 9/1966 | Bryan | 425/72 S |
| 3,313,001 | 4/1967 | Finzel et al. | 425/72 S |
| 3,707,593 | 12/1972 | Fukada et al. | 264/210 |
| 3,929,542 | 12/1975 | Gehrig et al. | 425/72 S |
| 3,954,361 | 5/1976 | Page | 425/72 S |
| 4,134,882 | 1/1979 | Frankfort et al. | 528/309 |
| 4,156,071 | 5/1979 | Knox | 528/272 |
| 4,195,051 | 3/1980 | Frankfort et al. | 264/176 |
| 4,202,855 | 5/1980 | Gerking et al. | 264/210.2 |
| 4,288,207 | 9/1981 | Wilkes | 425/72 S |
| 4,402,900 | 9/1983 | Berry, Jr. | 425/72 S |
| 4,405,297 | 9/1983 | Appel et al. | 425/72 S |
| 4,415,726 | 11/1983 | Tanji et al. | 528/272 |
| 4,425,293 | 1/1984 | Vassilatos | 264/176 |

FOREIGN PATENT DOCUMENTS

| | | |
|---|---|---|
| 48-43563 | 12/1973 | Japan . |
| 56-13806 | 3/1981 | Japan . |

OTHER PUBLICATIONS

Research Disclosure Journal Disclosure No. 10418, Dec. 1972.

*Fiber World*, Sep. 1984, pp. 8–12.

*Primary Examiner*—Hubert C. Lorin

[57] ABSTRACT

A melt-spinning process for spinning polymeric filaments at a spinning speed controlled by a positive mechanical withdrawal means that increases the speed of the filaments to above 7,000 meters/minute whereby a drawing and necking down of the filaments occur below the spinning pack, directing a gas into a zone extending from the spinning pack to a location between the spinning pack and the withdrawal means, maintaining the zone under superatmospheric pressure of less than 0.03 kg/cm2 and increasing the velocity of the gas as it leaves the zone to a level greater than the velocity of the filaments to reduce the extent of necking down of the filaments.

6 Claims, 4 Drawing Sheets

MELT SPINNING PROCESS FOR POLYMERIC FILAMENTS

BACKGROUND OF THE INVENTION

This invention concerns an improved apparatus and process for melt spinning uniform polymeric filaments, especially in the form of continuous filament yarns, by spinning at controlled withdrawal speeds.

It has long been known that polymeric filaments, particularly lighter denier textile filaments such as polyesters and polyamides, can be prepared directly, i.e., in the as-spun condition, without any need for drawing, by spinning at high speeds of the order of 5 km/min or more. This was first disclosed by Hebeler in U.S. Pat. No. 2,604,667 for polyesters, and by Bowling in U.S. Pat. No. 2,957,747 for polyamides. To improve process economics, there has been increased interest in the last 10 years, in melt-spinning uniform polymeric filaments without sacrificing good properties at the highest spinning speeds possible.

Frankfort et al. in U.S. Pat. Nos. 4,134,882 and 4,195,051 disclose new uniform polyester filaments and continuous filament yarns of enhanced dyeability, low boil-off shrinkage and good thermal stability, prepared by spinning and winding directly at withdrawal speeds of 5 km/min or more. The highest withdrawal speed (spinning speed) exemplified is 8000 ypm (7.2 km/min). The withdrawal speed is the speed of the first driven roll wrapped (at least partially) by the filaments, i.e., the feed roll. When uniform polymeric filaments are desired, such as are suitable for continuous filament yarns, for example, it is essential to use a roll or equivalent positive means, driven at a constant controlled speed to withdraw the filaments, as opposed to an air jet ejector. The latter is satisfactory for some uses, such as non-woven products, but does not produce filaments that are sufficiently uniform for use as continuous filament yarns for most purposes.

Tanji et al. U. S. Pat. No. 4,415,726 reviews several earlier references and disclose polyester filaments and yarns capable of being dyed under normal pressure, and a process for producing such polyester yarns with improved spinning stability at controlled high spinning (i.e., withdrawal) speeds of over 5 km/min. An important element is the subjection of the filaments to a vacuum or suction by an aspirator.

Vassilatos in U.S. Pat. No. 4,425,293 discloses an oriented amorphous polyethylene terephthalate textile feed yarn for false-twist texturing prepared by spinning polyethylene terephthalate at a speed of over 5000 m/min and quenching in a liquid bath to provide filaments having a boil off shrinkage (BOS) of at least 45% and no detectable crystallinity as measured by customary X-ray diffraction procedures. The yarn produced has a relatively low elongation to break (<30%).

There has also been increased interest in improving productivity of heavier denier, e.g., industrial, yarns via increased spinning speeds without sacrificing good yarn properties. Zimmerman in U.S. Pat. No. 3,091,015 disclosed a process for spinning heavier denier (e.g., 6 to 12 dpf) industrial yarns at speeds of 440 ypm at the first feed roll to produce the desirable low birefringence yarns needed to obtain good mechanical yarn properties after the drawing steps. It would be very desirable from an economic viewpoint to provide an improved process and apparatus which will remove the spinning speed limitations or raise the plateau which presently exists in the low denier textile yarns as well as heavy denier industrial yarns without sacrificing good filament properties. However, an article by Professor A. Ziabicki in *Fiber World*, September 1984, pages 8–12, entitled "Physical Limits of Spinning Speed" questions whether higher speeds can yield fibers with better mechanical properties, and whether there are any natural limits to spinning speed which cannot be overcome (concentrating on physical and material factors only, and excluding economical and technical aspects of the problem). Professor Ziabicki concludes that there exists such a speed, beyond which no further improvement of structure and fiber properties is to be expected. In the case of polyester textile filaments the maxima appear to Professor Ziabicki to be around 5–7 km/min. This is consistent with the results shown by Tanji at speeds up to 9 km/min. For the heavier denier industrial yarns, although no such statement was made, no disclosure in the published literature was found which taught how to raise the spinning speed plateau for these yarns.

Furthermore, it was found that processes disclosed in the above cited references either did not allow spinning at much above the current speeds due to process discontinuity problems or to drastic deterioration of filament properties as the spinning speeds increased.

In contrast to Tanji's disclosure of preparing polymeric filaments by winding at high withdrawal speeds, with an aspirator to assist the withdrawal of the filaments from the spinneret, there have been several disclosures of preparing polymeric filaments by extruding into a pressurized chamber and using air pressure, e.g., an air nozzle or an aspirator to withdraw the filaments from the pressurized chamber without use of any winder or other positively-driven roll to advance the filaments at a controlled speed. The resulting filaments have many uses, especially in non-woven fabrics, but do not have the uniformity required for most purposes as continuous filament yarns, because of the inherent variability (along the same filament and between different filaments) that results from use of only an air jet to advance the yarns, i.e., without a winder or other controlled positive-driving mechanism. Indeed, the resulting filaments are often so non-uniform as to be spontaneously crimpable, which can be of advantage, e.g., for use in non-wovens, but is undesirable for other uses.

Accordingly, it was very surprising, according to the invention, to provide an improved process for obtaining polymeric filaments and yarns by spinning at significantly higher than conventional spinning speeds, with similar or better mechanical properties than has been shown and predicted in the prior art for both light and heavy denier yarns.

SUMMARY OF THE INVENTION

According to the invention, there is provided an improved process for melt spinning uniform polymeric filaments through capillaries in a spinneret in a path to a positive mechanical withdrawal means that increases the speed of the filaments to above 7,000 meters/minute whereby a drawing and necking down of the filaments occur below the spinning pack wherein a cocurrent flow of gas is used to assist the withdrawal of the filaments, the improvement being characterized in that said gas is directed, under a controlled positive pressure of less than about one (1) kg/cm$^2$, preferably less than 0.03 kg/cm$^2$, into an enclosed zone extending from the spinneret to a location between the spinneret and the withdrawal means, maintained under superatmospheric pressure, and the velocity of the gas is increased to a level greater than the velocity of the filaments as the gas leaves the zone. The enclosed zone is formed from a housing extending from the spinneret on one end to a location between the spinneret and the withdrawal means at its other end. The means for increasing the velocity of the gas as it leaves the zone may be a venturi, having a converging inlet and a flared outlet connected by a constriction, with the converging inlet being joined to the other end of the housing. As an alternative, the means for increasing the velocity of the gas as it leaves the zone may be a tube joined to the other end of the housing with a continuous wall surrounding the tube to form an annular space surrounding the tube with wall adjoining the housing and means for supplying pressurized gas to the annular space.

Spinning continuity can be improved at these high withdrawal speeds by these means which smoothly accelerate the cocurrent air-flow and thereby tension the filaments close to the face of the spinneret. The velocity of air or other gas in the venturi may be about one and one half (1.5) to about one hundred (100) times the velocity of the filaments so that the air exerts a pulling effect on the filaments. As a result of the higher velocity and high temperature of the filaments leaving the venturi, the extent of necking down that would otherwise be normally experienced by the filaments at these high speeds is appreciably reduced, so that the filaments are oriented more highly and more uniformly (less difference between amorphous sections and crystalline sections). Consequently, the filaments have higher tenacity, greater elongation to break and there is better spinning continuity, especially as the withdrawal speed is increased beyond 7 km/min.

It is very surprising that it is possible for multiple strands of hot sticky polymer to converge and pass through a venturi with a relatively small constriction or a small diameter tube with sufficient stability that they would not stick to each other, or adhere significantly to the walls of either. One reason for such success may be the extremely low superatmospheric pressure in the zone above the venturi or tube. Because of the nature of the strands immediately under the spinneret, it is not practical to correct any problem of sticking by means of a guide. If filaments touch each other, they would be expected to coalesce, as has been taught in the art, and it would be very difficult to separate them. Similarly, each time a filament touches the funnel it will leave a polymer deposit, thus further increasing the future tendency for sticking. As many as 34 filaments have been spun successfully at 310° C. (some 40° above the melting point of the polymer) through a constriction about 1 cm in diameter.

An aspirating jet is preferably used downstream below the venturi to assist cooling and further reduce aerodynamic drag so as to further reduce spinning tension and increase spinning continuity.

DETAILED DESCRIPTION OF THE ILLUSTRATED EMBODIMENT

Figure 1:
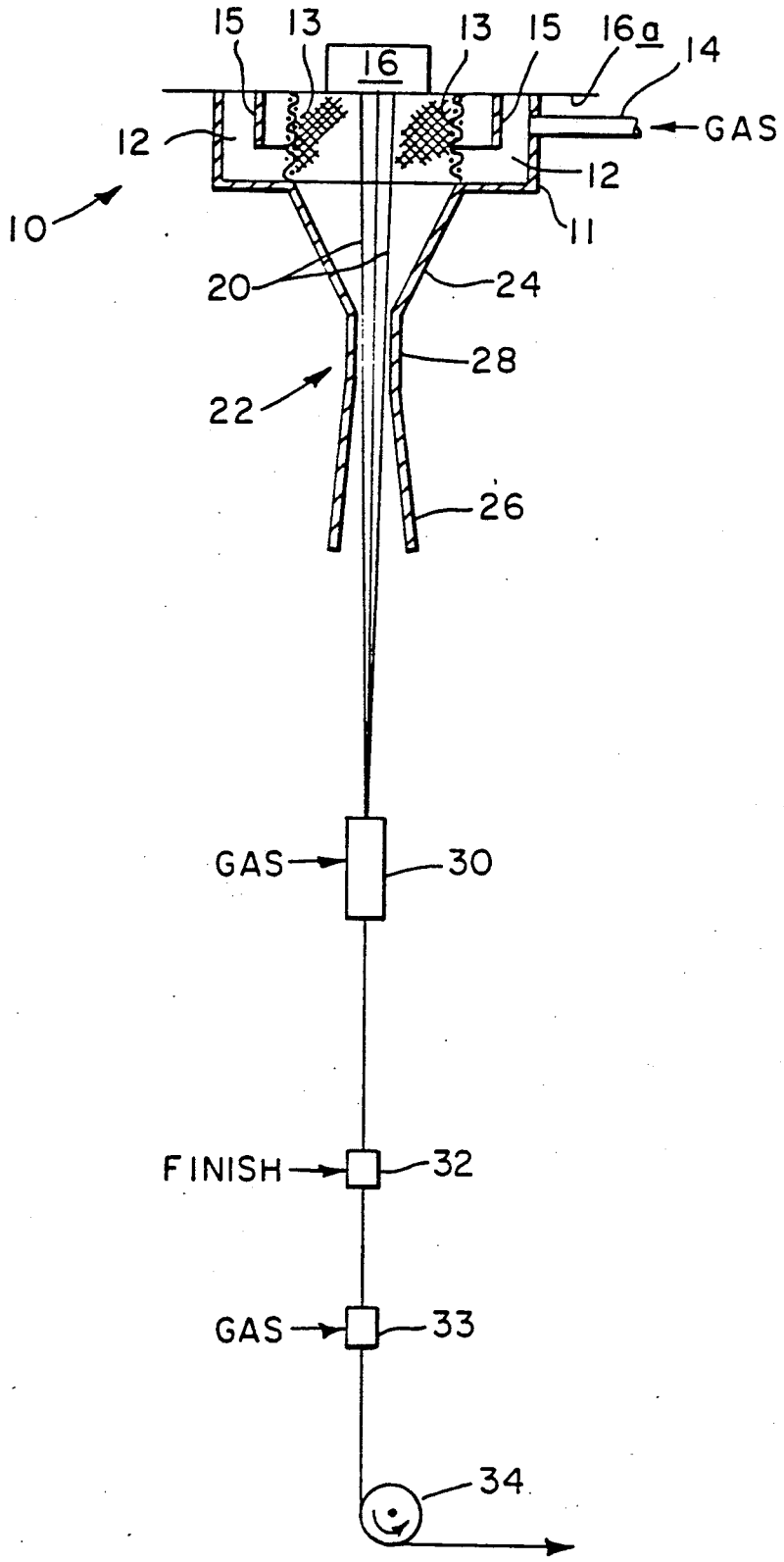
FIG. 1. is a schematic elevation view partially in section of one embodiment of the apparatus for practicing the invention.

Referring to FIG. 1, this embodiment includes a housing 10 which forms a chamber 12, i.e., an enclosed zone supplied with a gas through inlet conduit 14 which is formed in the side wall 11 of the housing. A circular screen 13 and a circular baffle 15 are concentrically arranged in housing 10 to uniformly distribute the gas flowing into chamber 12. A spinning pack 16 is positioned centrally with and directly above the housing which abuts the surface **16*a* of the pack. A spinneret (not shown) is attached to the bottom surface of the spinning pack for extruding filaments 20 into a path from molten polymer supplied to the pack. A venturi 22 comprising a flared inlet 24 and a flared outlet 26 connected by a constriction 28 is joined at its inlet to housing 10. An aspirating jet 30 located downstream of the venturi 22 is followed by a withdrawal roll 34**.

In operation, a molten polymer is metered into spinning pack 16 and extruded as filaments 20. The filaments are pulled from the spinneret into a path by withdrawal roll 34 assisted by the gas flow through the venturi 22 and the aspirating jet 30.

The terms withdrawal speed and spinning speed, and sometimes winding speed are used when discussing Frankfort et al. and Tanji, to refer to the linear peripheral roll speed of the first driven roll that positively advances the filaments as they are withdrawn from the spinneret. According to the invention, while the air flow through the venturi 22, and through the aspirator 30 is important in assisting withdrawal roll 34 to pull the filaments 20 away from the spinneret, such air flow is not the only force responsible for withdrawal of the filaments. This contrasts with the prior art such as is mentioned above, which uses air flow as the only means of withdrawing and drawing filaments from the spinneret, The temperature of the gas in the enclosed zone 12 may be from 5° C. to 250° C. The preferred distance between the face of the spinneret located at the lower surface of spinning pack 16 and the throat or restriction 28 of venturi 22 is from about 6 to 60 inches. The diameter (or equivalent width of the cross-sectional area) of the throat or constriction 28 should preferably be from about 0.25 to 1 inch but this will depend to some extent on the number of filaments in the bundle. If a rectangular slot is used, the width may be even less, e.g., as little as 0.1 inches. If the width is too small, the filaments may touch each other in the nozzle and fuse. If the diameter of constriction 28 is too large, a correspondingly large amount of gas flow will be required to maintain the desired velocity at the throat and this may cause undesirable turbulence in the zone and so filament instability will result.

The pressure in the housing 10 should be high enough to maintain the desired flow through the venturi 22. Normally, it is between about 0.01 kg/cm$^2$ to 1 kg/cm$^2$ depending on the dimensions, and on the filaments being spun, namely the denier, viscosity and speed. As mentioned, a low superatmospheric pressure is important.

The flared outlet of the venturi 26, should preferably be of length between about 1 and 30 inches, depending on the spinning speed. The preferred geometry of the flared outlet 26 is divergent with a small angle, e.g., 1° to 2° and not more than about 10°, so that the converging inlet 24, the constriction 28, and the flared outlet 26 together form a means for increasing the velocity of the gas as it leaves zone 12. The flared outlet 26 allows the high velocity air to decelerate and reach atmospheric pressure at the exit from this outlet without gross eddying, i.e., excessive turbulence. Less divergence, e.g., a constant diameter tube may also work at some speeds, but would require a higher supply pressure to obtain the same gas flow. More divergence leads to excessive turbulence and flow separation.

Filaments emerging from the venturi are allowed to cool in the atmosphere, preferably for a short distance before entering an aspirating jet 30 placed at a suitable distance down stream of the venturi 22. Normally neck-draw takes place in this zone between the venturi and the aspirating jet 30. It is desirable to separate the aspirating jet from the venturi because the amount of air aspirated with the filaments by the aspirating jet may be substantially larger than the amount of air flowing out from the venturi, and so to avoid a large mismatch in flow rates which would lead to turbulence and yarn instability. The function of the aspirating jet is to cool the filaments rapidly to increase their strength and to reduce the increase in spinning tension due to aerodynamic drag.

A finish (anti-stat, lubricant) is applied to the filaments by means of finish applicator 32. This should be downstream of the aspirating jet 30, but ahead of the withdrawal roll 34. An air interlacing jet 33 may be used to provide the filaments with coherence, when the object is to prepare a continuous filament yarn. This is located downstream of any finish applicator.

Figure 2:
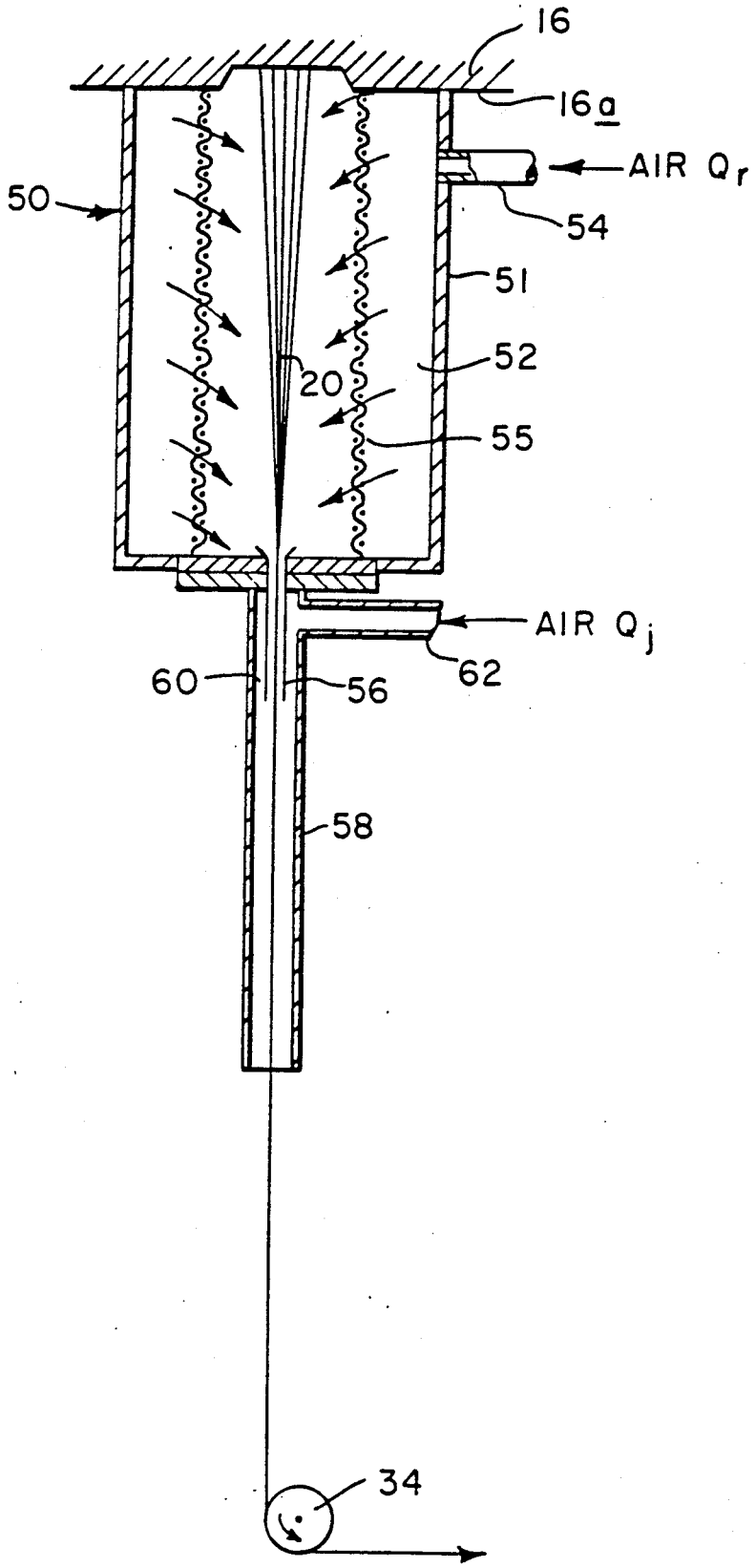
FIG. 2. is a schematic elevation view partially in section of another embodiment of an apparatus for practicing the invention.

In another embodiment of the apparatus shown in FIG. 2 the means for increasing the velocity of the gas includes a housing 50 which forms a chamber 52 supplied with a pressurized gas $Q_r$ through inlet conduit 54 which is formed in the side wall 51 of the housing. A cylindrical screen 55 is positioned in chamber 52 to uniformly distribute gas flowing into the chamber. A spinning pack 16 is positioned centrally with and directly above the housing which abuts and is sealed to the surface 16*a* of the pack. A spinneret (not shown) is attached to the bottom surface of the spinning pack for extruding filaments 20 into a path from molten polymer supplied to the pack. A tube 56 is joined to the housing 50 at the outlet end of the housing in line with the path of the filaments. The top of the tube is slightly flared. A continuous wall or second tube 58 surrounds tube 56 and is spaced therefrom to form an annular space 60 surrounding the tube 56. The wall is joined to the housing 50 at the outlet of the housing. An inlet pipe 62 through the wall 58 provides a means to supply pressurized gas $Q_j$ to space 60. The operation is similar to that described for FIG. 1 except the withdrawal of the filaments is assisted by the gas flow through straight tube 56. The diameters of tubes 56, 58 and the air flow rates $Q_r$ and $Q_j$ are chosen in such a way as to have equal average gas velocity in both tubes. In this manner disturbance of the filaments at the exit of tube 56 into the tube 58 is minimized. Furthermore, the tube 56 should be well centered and the flow $Q_j$ uniformly distributed so that the gas velocity in the annulus 60 between the two tubes is the same at any circumferential position. Also, the velocity of the gas in the annulus should be about two (2) times greater than the common velocity in the two tubes, but not significantly greater than that.

Figure 3:
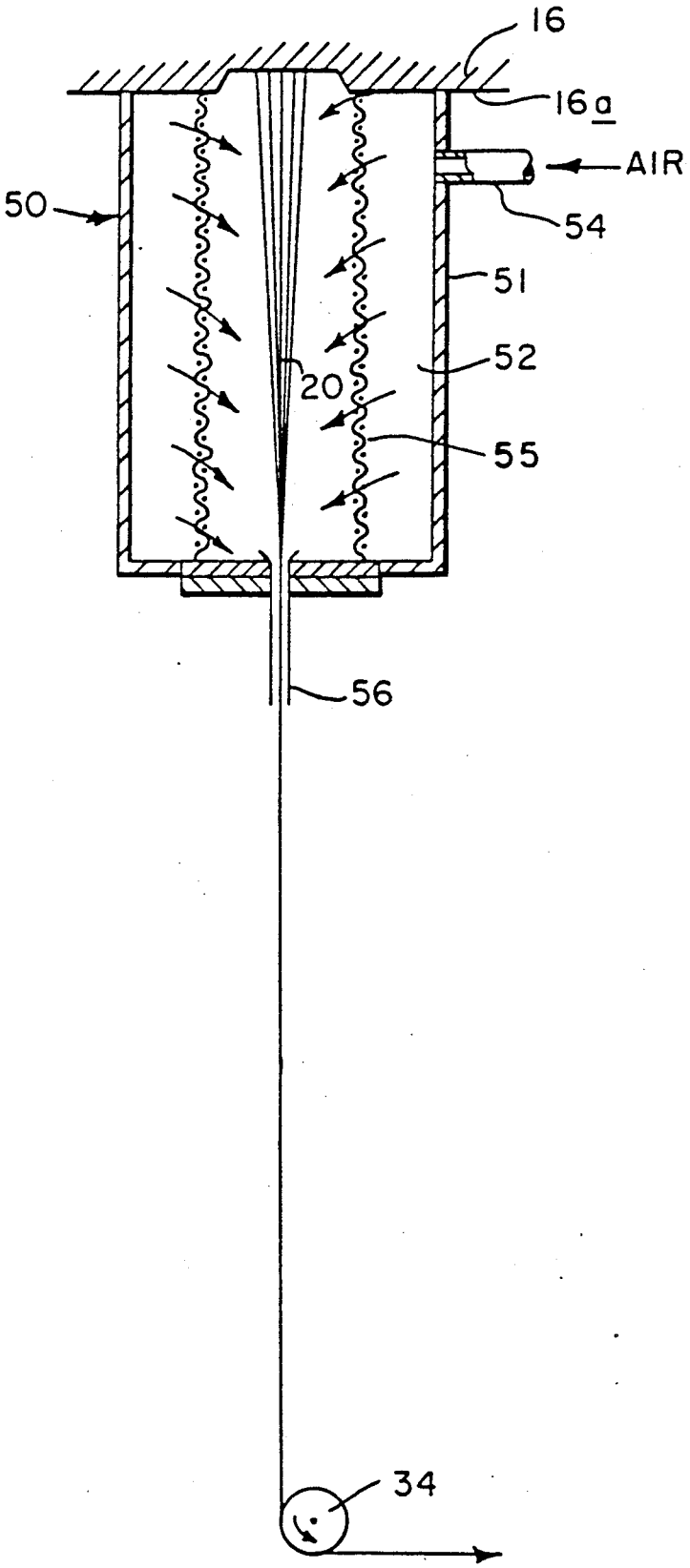
FIG. 3. is a schematic elevation view of still another embodiment of the apparatus for practicing the invention.
Figure 4:
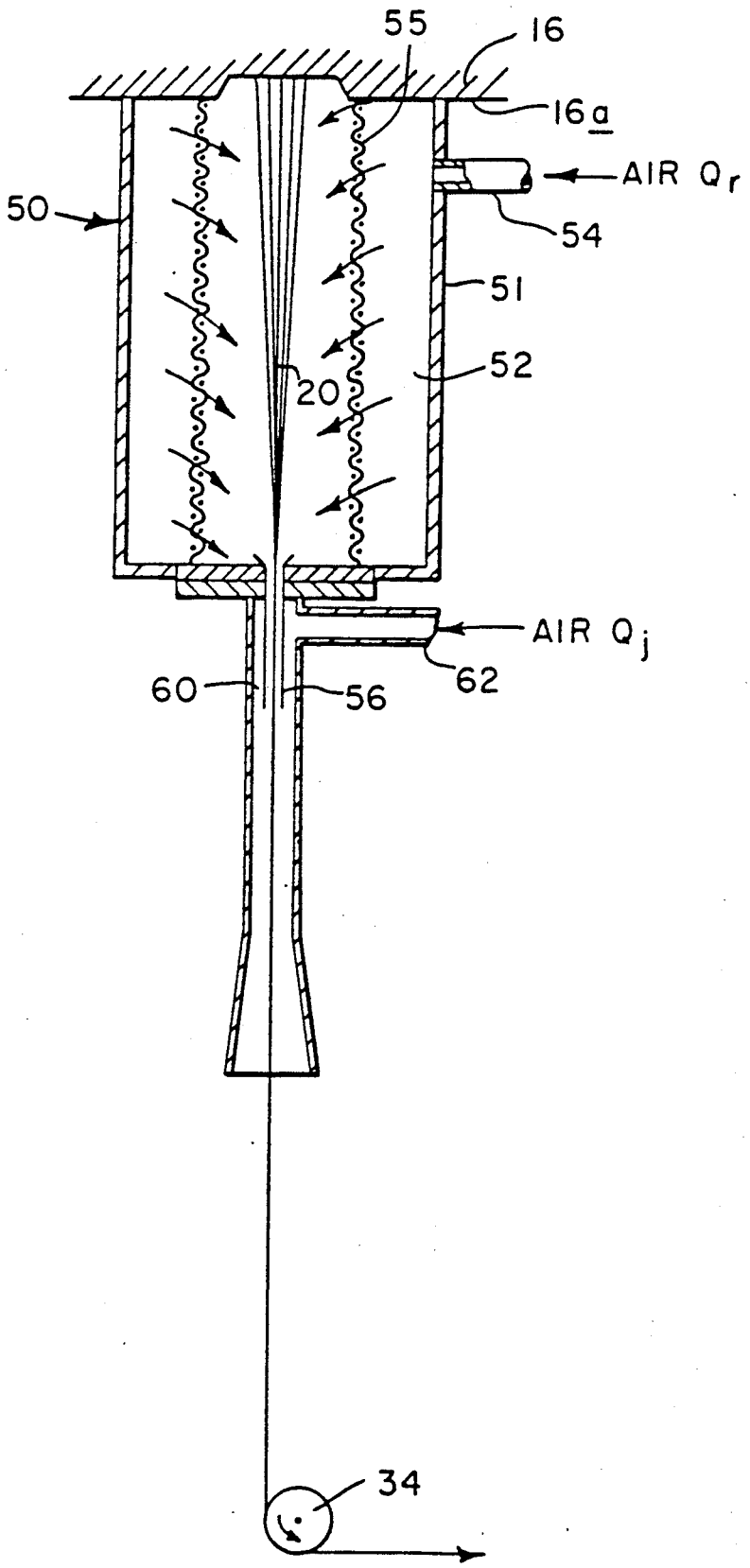
FIG. 4 is a schematic elevation of an improvement made to FIG. 2.

FIGS. 3 and 4 illustrate embodiments similar to FIG. 2. In FIG. 3 the tube 58 is removed. Operation is in the manner described in Example III. In FIG. 4 the wall of the outer tube 58 has a divergent outlet 62. This minimizes turbulence at the breakup point of the gas stream outside the tube 58.

TESTS

T/E/Mi—tenacity and initial modulus are in grams per denier and elongation is in %, measured according to ASTM D2256 using a 10 in (25.4 cm) gauge length sample, at 65% RH and 70 degrees F., at an elongation rate of 60% per min.

Density—determined from density gradient tube experiments by the method of ASTM D15056-68.

Birefringence—measured with a polarizing microscope by the Sonarmont method.

Boil Off Shrinkage (BOS)—measured described in U.S. Pat. No. 4,156,071 at Column 6, line 51.

Endotherm—the endotherm (melting point) is determined by the inflection point of a differential scanning calorimeter curve, using a Du Pont model 1090 Differential Scanning Calorimeter operated at a heating rate of 20°C./min.

EXAMPLE I

Polyethylene terephthalate, having an intrinsic viscosity of 0.63 which is measured in a mixed solution of 1:2 volume ratio of phenol and tetrachloroethane, was extruded from a spinneret having 17 fine holes of 0.25 mm dia equally spaced on a circumference of a circle of 5 cm in diameter at a spinning temperature of 310° C. using the apparatus shown in FIG. 1. The extruded filaments were passed through a cylinder with an inside diameter of 11.5 cm and a length of 13 cm provided immediately below the surface of the spinneret. The cylinder was maintained at a temperature of 180° C. and air at the same temperature was supplied through the wire mesh inside surface of the cylinder at the rate of 4.5 scfm. The cylinder was connected to a converging tube with a throat diameter of 9.5 mm (0.375") located at the end of the tube 30 cm from the spinneret. Beyond the throat is a divergent tube (forming a venturi) of 17 cm in length with a divergence cycle of 2°. The heated cylinder is sealed against the bottom of spinning block so that air supplied through the cylinder can only escape through the throat of convergent tube and the venturi. A positive pressure of about 0.15 psi (0.01 kg/cm$^2$) is maintained in the chamber below the spinneret. Upon leaving the venturi, the filaments travel in air for about 40–70 cm before entering an aspirating jet supplied with air pressure of 3 psig. The filaments have a denier of 42.5/17 (2.5 dpf). The denier was maintained at speeds of 7,000 m/min to 12,000 m/min by adjusting polymer feed through the spinneret capillaries. Properties of the fibers are shown in Table I.

TABLE I

TENACITY AND ORIENTATION OF POLYESTER FIBERS

| Spinning Speed m/min | T/E/M$_i$ g/d | Ten at Break g/d | Biref |
|---|---|---|---|
| 7,000 | 4.4/36/94 | 6.0 | 0.125 |
| 8,000 | 4.7/26/118 | 5.9 | 0.128 |
| 9,000 | 4.9/23/112 | 6.0 | 0.128 |
| 10,000 | 4.7/21/100 | 5.7 | 0.119 |

TABLE I-continued

| TENACITY AND ORIENTATION OF POLYESTER FIBERS | | | |
|---|---|---|---|
| Spinning Speed m/min | T/E/$M_i$ g/d | Ten at Break g/d | Biref |
| 11,000 | 4.7/16/115 | 5.5 | 0.113 |
| 12,000 | 4.5/15/110 | 5.2 | 0.108 |

EXAMPLE II

A commercially available polypropylene (U.S. Steel, Code CP-320D) is melted in a twin screw extruder and spun into a 17 filament, 35 denier (3.9 tex) yarn, using the apparatus shown in FIG. 1. Polymer Mw/Mn is ca 4, melt flow rate is 31.5, and low shear melt viscosity is about 1000 poises at 260° C. Spinning temperature (pack) is about 250° C. Quench air velocity in the venturi jet is 7 to 8 scfm (0.20–0.23 standard cubic meters per minute) and the air temperature is 23° C. After passing through the venturi, a finish is applied, the yarn is interlaced and then collected. Properties are shown in Table II.

TABLE II

| Spinning Speed m/min | T/E/Mi | Density | Bire-fringence | DSC Endotherm °C. |
|---|---|---|---|---|
| 6000 | 2.7/125/32 | 0.919 | .022 | 161.5 |
| 7000 | 2.6/114/38 | 0.920 | .022 | 160.8 |
| 8000 | 2.6/96/43 | 0.921 | .023 | 164.3 |
| 9000 | 2.6/80/43 | 0.924 | .024 | 164.7 |

For comparison, yarns are spun under similar conditions but with the housing 10 and venturi 22 removed. Properties are shown in Table III.

TABLE III

| Spinning Speed m/min | T/E/Mi |
|---|---|
| 7000 | 1.8/123/37 |
| 8000 | 1.8/79/36 |
| 9000 | 1.9/70/43 |

EXAMPLE III

Polyethylene terephthalate, having an intrinsic viscosity of 0.63 which is measured in a mixed solution of 1:2 volume ratio of phenol and tetrachloroethane, was extruded from a spinneret having 4 fine holes of 0.25 mm diameter equally spaced 0.25 cm apart on a straight line at a spinning temperature of 290° C., and at a rate of 3.1 gms per minute per hole. The extruded filaments were passed through an air supplying chamber with an inside diameter of 7.6 cm and a length of 43 cm provided immediately below the surface of the spinneret. Air of about 20° C. was supplied through the wire mesh cylinder at the rate of 30 scfm. The bottom of the housing was covered by a plate with an opening at its center which allowed a tube with an inside diameter of 1.25 cm and a length of 5.0 cm to be attached to it. The top of the tube was slightly flared as shown in FIG. 3.

The air supplying chamber is sealed against the bottom of the spinning block so that air supplied through the chamber can only escape through the tube at its bottom. The air flow rate was measured and the pressure maintained in the chamber below the spinneret was calculated to be about 0.01 kg/cm$^2$ above the atmospheric pressure. Upon leaving the tube, the filaments travel in air for about 280 cm before taken up by rotating rolls. When the takeup speed of the rolls was 5,948 m/min, the velocity of the spinning filaments at the exit of the tube was 1,280 m/min or about 19% of the velocity of the air in the tube. Furthermore, the velocity profile of the spinning filaments increased smoothly to the final takeup velocity without sign of any sudden velocity change which is known as "neck" formation. This is an indication that no significant crystallization took place along the spinning filament. This contrasts the velocity profile of the spinning filaments without the tube at the bottom of the air supplying chamber. In the latter case, the velocity profile showed a sudden and sharp increase ("neck" formation) from about 1,647 m/min to the final velocity of 5,948 m/min at a distance of about 118 cm from spinneret exit. At the location corresponding to the exit of the tube, the velocity of the spinning threadline was about 229 m/min. The takeup speeds of the fibers and their properties are shown in Table IV. Finish and mild interlacing were applied to the spinning filaments before they reached the takeup roll.

TABLE IV

| Spinning or Take-up Speed m/min | % BOS | Density gms/ml | Tenacity g/d | % Elongation to break | Modulus g/d |
|---|---|---|---|---|---|
| 6,405 | 45 | 1.3578 | 2.3 | 79 | 47 |
| 7,320 | 32 | 1.3563 | 2.5 | 38 | 70 |
| 8,235 | 15 | 1.3668 | 3.0 | 31 | 75 |

EXAMPLE IV

Polyethylene terephthalate, having an intrinsic viscosity of 0.63 which is measured in a mixed solution of 1:2 volume ratio of phenol and tetrachloroethane, was extruded from a spinneret having 17 fine holes of 0.25 mm diameter of which seven and ten holes were equally spaced on the circumference of two circles of 3.8 cm and 5.4 cm in diameter respectively at a spinning temperature of 290° C. and at a rate of 2.5 gms per minute per hole.

The extruded filaments were passed through an air supplying chamber as described in Example III. The tube attached to the bottom of the chamber had an inside diameter equal to 1.27 cm and a length equal to 15.3 cm. This tube discharged the gas into a second tube of an inside diameter equal to 1.9 cm and length equal to 17.8 cm as shown in FIG. 2. Additional quench gas of a flow rate $Q_j$ equal to 25 scfm was metered into the tube. The flow $Q_r$ metered into the chamber was 20 scfm. Both streams were at about 20° C. The air flows were measured and the pressure maintained in the cylinder below the spinneret was calculated to be about 0.02 kg/cm$^2$. The filaments exiting the small tube were straight, taut and separate from each other. They remained so even when traveling in the larger outside tube as could be observed through the transparent plastic walls of the tube. The impovement brought about by the outside tube consisted in keeping the filaments straight and separated until they had the time to cool more to minimize potential sticking between them upon exiting the large tube where the breakup of the exiting gas stream might create turbulence. Furthermore, the use of two controlled gas flows, $Q_r$ and $Q_j$, provides more process control. It allows control of the spinning filament velocity profile and of its temperature profile as well. For example, by adding the second stream $Q_j$, a larger heat sink becomes available for the filaments to cool because the gas mass is greater and its temperature does not rise significantly. The takeup speeds of the fiber and their properties are shown in Table V. Finish and mild interlacing were applied to the spinning filaments before they reached the takeup roll.

TABLE V

| Spinning or Take-up Speed m/min | % BOS | Density gms/ml | Tenacity g/d | % Elongation to break | Modulus g/d |
|---|---|---|---|---|---|
| 7,000 | 63 | 1.3570 | 2.4 | 65 | 41 |
| 8,000 | 50 | 1.3582 | 3.0 | 53 | 51 |
| 9,000 | 21 | 1.3688 | 3.4 | 37 | 55 |

EXAMPLE V

Nylon 66, having a relative viscosity of 55.3, was extruded from a spinneret having 5 fine holes of 0.25 mm diameter equally spaced on a circumference of a circle of 1.9 cm in diameter at a spinning temperature of 290° C. and a rate of 2.5 gms per minute per hole. The extruded filaments were passed through the air supplying chamber and the two tubes attached to it exactly as described in Example IV. The air flow rates $Q_r$ and $Q_j$ were 20 and 25 scfm respectively. Finish and mild interlacing were applied to the filaments. The spinning speeds and yarn properties are shown in Table VI.

TABLE VI

| Spinning or Takeup Speed m/min | Tenacity g/d | % Elongation to Break | Modulus(i) g/d |
|---|---|---|---|
| 6,000 | 2.4 | 95.7 | 30.4 |
| 7,000 | 2.6 | 82.2 | 33.2 |
| 8,000 | 2.8 | 74.3 | 34.9 |
| 8,500 | 2.9 | 58.0 | 44.9 |
| 9,000 | 2.8 | 45.5 | 41.6 |
| 9,500 | 3.0 | 44.6 | 39.6 |

EXAMPLE VI

Polypropylene having a melt flow rate of about 32 was extruded from a spinneret having 5 fine holes of 0.25 mm diameter equally spaced on a circumference of a circle 1.9 cm in diameter at a spinning temperature of 245° C. and a rate of 1.46 gms per minute per hole. The extruded filaments were passed through the apparatus described in Example IV. The spinning speed and the air flow rates $Q_r$ and $Q_j$ are shown in Table VII. The temperature of the air used was 20° C.

TABLE VII

| Spinning or Take-up Speed m/min | Air Flow Rate $Q_r$ scfm | Air Flow Rate $Q_j$ scfm | Density gms/ml | Tenacity g/d | % Elongation to Break | Modulus g/d |
|---|---|---|---|---|---|---|
| 6860 | 20 | NA | 0.8813 | 1.6 | 126 | 13 |
| 6860 | 20 | 25 | 0.8918 | 1.8 | 107 | 13 |
| 6860 | 25 | 32.5 | 0.9053 | 1.9 | 135 | 28 |

The top entry of Table VII represents the control. Only the air supplying cylinder was used in this case with its bottom open. No tubes were attached to it. Table VII shows that an increase in tenacity and modulus is realized when the device of the present invention is used.

EXAMPLE VII 6-6 nylon having a relative viscosity of 60 measured in formic acid was extruded from a spinneret having 10 holes of 0.25 mm dia equally spaced on a circumference of a circle of 5 cm in diameter at a spinning temperature of 290° C. using the apparatus shown in FIG. 1. The extruded filaments were passed through the air supplying chamber maintained at a temperature of 100° C. Air flow rate was 6 scfm. A positive pressure of about 0.01 kg/cm$^2$ was maintained in the chamber. Upon leaving the venturi, the filaments travel in air for about 70 cm before entering an aspirating jet supplied with air at 3 psig. The denier was maintained at 25 at speeds of 6,000 m/min to 12,000 m/min by adjusting polymer feed through the spinneret capillaries. Properties of the fibers are shown below in Table VIII.

TABLE VIII

| Spin or Takeup Speed | T/E/$M_i$ | Biref. |
|---|---|---|
| 6,000 | 3.0/94/14 | .0397 |
| 7,000 | 2.8/68/14 | .0422 |
| 8,000 | 2.9/59/18 | .0438 |
| 9,000 | 3.2/55/22 | .0453 |
| 10,000 | 2.9/38/25 | .0469 |
| 11,000 | 3.2/36/30 | .0480 |
| 12,000 | 2.9/27/28 | .0500 |

Similarly 6-6 nylon having a relative viscosity of 45 measured in formic acid was extruded from the same spineret using apparatus similar to that shown in FIG. 1. Properties of the fibers are shown below in Table IX.

TABLE IX

| Spin or Takeup Speed | T/E/$M_i$ | Biref. |
|---|---|---|
| 6,000 | 2.8/68/13 | .038 |
| 7,000 | 3.9/52/21 | .045 |
| 8,000 | 4.4/47/25 | .047 |
| 9,000 | 4.6/40/30 | .049 |
| 10,000 | 4.7/38/37 | .050 |

EXAMPLE VIII (6-6) Nylon having a relative viscosity of 70 which is measured in a solution of formic acid, was extruded from a spinneret having 10 fine holes of 0.30 mm in diameter and 1.3 mm long on a circumference of a circle of 5 cm in diameter a spinning temperature of 300° C. The extruded filaments were passed through a cylinder as described and a venturi with an air flow of 6 SCFM at 23° C. as shown in FIG. 1. Upon leaving the venturi, the filaments were collected at 1000 m/min by winding on a cylindrical package. Subsequently orientation of the filaments was determined by optical birefrigence. The yarn denier was 300/10. Birefringence was 0.012. By comparison filaments spun without using the cylinder and venturi of FIG. 1 had a birefringence of 0.017. The higher value of birefringence limits drawability of the yarn to a lower level of draw ratio which, in turn, produces yarn with a lower level of tensile properties. Alternatively, to produce yarn with a comparable level of properties, the winding speed will have to be reduced from 1000 m/min to about 400 m/min if the apparatus of the subject invention is not used.

What is claimed is:

1. In melt-spinning process for spinning continuous polymeric filaments in a path from a spinning pack at a spinning speed controlled by a positive mechanical withdrawal means that increases the speed of the filaments to above 7,000 meters/minute whereby a drawing and necking down of the filaments occur below the spinning pack, the improvement for increasing tenacity, elongation and spinning continuity of the filaments comprising: directing a gas into a zone enclosing said path, said zone extending from said spinning pack to a location between the spinning pack and the positive mechanical withdrawal means; maintaining said zone under superatmospheric pressure of less than 0.03 $kg/cm^2$ and increasing the velocity of the gas as it leaves the zone to a level greater than the velocity of the filaments to reduce the extent of necking down of said filaments.

2. The process of claim 1, said polymeric filaments being polyester.

3. The process of claim 1, said filaments being nylon.

4. The process of claim 1, said filaments being polypropylene.

5. The process of claim 2, 3 or 4, said gas being air, the temperature of said gas being from about 5° C. to about 250° C.

6. The process of claims 2, 3 or 4, the velocity of the gas leaving said zone being increased from 1.5 to about 100 times the velocity of the filaments.

* * * * *